US009933195B2

(12) United States Patent
Roth et al.

(10) Patent No.: US 9,933,195 B2
(45) Date of Patent: Apr. 3, 2018

(54) EVAPORATOR ASSEMBLY FOR ICE-MAKING APPARATUS AND METHOD

(71) Applicant: Scotsman Industries, Inc., Vernon Hills, IL (US)

(72) Inventors: Keith H. Roth, Crystal Lake, IL (US); Chris J. Salatino, Arlington Heights, IL (US); Jonathan V. Stockton, Libertyville, IL (US)

(73) Assignee: Scotsman Group LLC, Vernon Hills, IL (US)

( * ) Notice: Subject to any disclaimer, the term of this patent is extended or adjusted under 35 U.S.C. 154(b) by 0 days.

(21) Appl. No.: 15/453,529

(22) Filed: Mar. 8, 2017

(65) Prior Publication Data

US 2017/0176078 A1 Jun. 22, 2017

Related U.S. Application Data

(62) Division of application No. 14/522,925, filed on Oct. 24, 2014.

(51) Int. Cl.
*F25C 5/08* (2006.01)
*F25C 5/02* (2006.01)
(Continued)

(52) U.S. Cl.
CPC ..... *F25C 1/12* (2013.01); *F25B 39/02* (2013.01); *F25C 5/10* (2013.01); *F28F 1/22* (2013.01);
(Continued)

(58) Field of Classification Search
CPC .... F25C 1/12; F25C 1/08; F25C 1/125; F25C 1/14; F25C 1/142; F25C 5/08; F25C 5/10; F25B 39/022; F25B 39/024
(Continued)

(56) References Cited

U.S. PATENT DOCUMENTS 4,474,023 A * 10/1984 Mullins, Jr. ..... F25C 1/12 62/137
4,990,169 A 2/1991 Broadbent
(Continued)

FOREIGN PATENT DOCUMENTS

CN 1375050 A 10/2002
CN 2935024 Y 8/2007
(Continued)

OTHER PUBLICATIONS

International Search Report dated Jan. 5, 2016 for International Application No. PCT/US2015/056448.
(Continued)

*Primary Examiner* — Frantz Jules
*Assistant Examiner* — Steve Tanenbaum
(74) *Attorney, Agent, or Firm* — Schiff Hardin LLP

(57) ABSTRACT

An evaporator assembly for an ice-making apparatus having a vertical, substantially flat freeze surface, a refrigerant circuit, and a freeze template. The freeze template is thermally coupled between the freeze surface and the refrigerant circuit, and is formed of a plurality of regions arranged in a plane and interconnected by strips having a smaller dimension in the plane than the regions. Interface locations between the freeze template and the freeze surface define where on the freeze surface ice is to be formed. During a freeze cycle, expanded refrigerant is passed through the refrigerant circuit, and water is run over the freeze surface. During a harvest cycle, compressed refrigerant is passed through the refrigerant circuit, wherein heat transfers from the refrigerant circuit to the freeze surface until the freeze surface is warmed to a temperature sufficient to allow ice formed on the freeze surface to fall from the freeze surface by a force of gravity.

12 Claims, 7 Drawing Sheets

(51) Int. Cl.

| | |
|---|---|
| ***F25C 1/00*** | (2006.01) |
| ***F25C 1/12*** | (2006.01) |
| ***F25B 39/02*** | (2006.01) |
| ***F28F 1/22*** | (2006.01) |
| ***F25C 5/10*** | (2006.01) |
| *F28D 1/047* | (2006.01) |

(52) U.S. Cl.
CPC ..... *F28D 1/0477* (2013.01); *F28F 2215/08* (2013.01)

(58) Field of Classification Search
USPC ..... 62/71, 73–74, 349
See application file for complete search history.

(56) References Cited

U.S. PATENT DOCUMENTS

| | | | | |
|---|---|---|---|---|
| 5,329,780 | A * | 7/1994 | Broadbent | F25C 1/125 62/353 |
| 5,924,301 | A | 7/1999 | Cook | |
| 6,247,318 | B1 | 6/2001 | Stensrud et al. | |
| 7,703,299 | B2 * | 4/2010 | Schlosser | F25B 39/02 165/171 |
| 8,677,774 | B2 | 3/2014 | Yamaguchi et al. | |
| 2005/0150250 | A1 | 7/2005 | Allison et al. | |
| 2006/0288725 | A1 * | 12/2006 | Schlosser | F25B 39/02 62/347 |
| 2007/0101753 | A1 | 5/2007 | Broadbent | |
| 2008/0104991 | A1 * | 5/2008 | Hoehne | F25C 1/22 62/340 |

FOREIGN PATENT DOCUMENTS

| | | | |
|---|---|---|---|
| CN | 101287953 | A | 10/2008 |
| CN | 104101153 | A | 10/2014 |
| EP | 2136165 | A2 | 12/2009 |
| ES | 2436631 | B1 | 10/2014 |
| GB | 1182971 | A | 3/1970 |
| GB | 2461043 | A | 12/2009 |

OTHER PUBLICATIONS

Partial Search report dated Jan. 27, 2017 for European Patent Application No. 15852187.
Office Action dated Jul. 19, 2017 for Chinese Patent Application No. 201580004817.9.

* cited by examiner

EVAPORATOR ASSEMBLY FOR ICE-MAKING APPARATUS AND METHOD

TECHNICAL FIELD

The present disclosure relates generally to an ice-making apparatus and method, and more particularly, to an evaporator assembly for an ice-making apparatus and method.

BACKGROUND

Ice-making apparatuses are used to supply cube ice in commercial operations. Typically, ice-making apparatuses produce clear ice by flowing water on a vertical, freeze surface. The freeze surface is thermally coupled to a refrigerant circuit forming part of a refrigeration system. The freeze surface commonly has freeze surface geometry for defining ice cube shapes. As water flows over the geometrical definitions, it freezes into cube ice.

FIG. 5 illustrates a circuit diagram of a refrigeration system 500 that can be used with an evaporator assembly of an ice-making apparatus.

The refrigeration system 500 includes a compressor 510, a condenser 520, an expansion device 530, a refrigerant circuit 540, and a solenoid 550. The refrigerant circuit 540 is formed in a serpentine shape and is known as an serpentine.

During operation, the ice-making apparatus alternates between a freeze cycle and a harvest cycle. During the freeze cycle when ice cubes are produced, water is routed over a freeze portion (not shown) on which the water freezes into ice cubes. At the same time, the compressor 510 receives low-pressure, substantially gaseous refrigerant from the refrigerant circuit 540, pressurizes the refrigerant, and discharges high-pressure, substantially gaseous refrigerant to the condenser 520. Provided the solenoid valve 550 is closed, the high-pressure, substantially gaseous refrigerant is routed through the condenser 520. In the condenser 520, heat is removed from the refrigerant, causing the substantially gaseous refrigerant to condense into a substantially liquid refrigerant.

After exiting the condenser 520, the high-pressure, substantially liquid refrigerant encounters the expansion device 530, which reduces the pressure of the substantially liquid refrigerant for introduction into the refrigerant circuit 540. The low-pressure, liquid refrigerant enters the refrigerant circuit 540 where the refrigerant absorbs heat and vaporizes as the refrigerant passes therethrough. This low-pressure, liquid refrigerant in the refrigerant circuit 540 cools the freeze portion, which is thermally coupled to the refrigerant circuit 540, to form the ice on the freeze portion. Low-pressure, substantially gaseous refrigerant exits the refrigerant circuit 540 for re-introduction into the compressor 510.

To harvest the ice cubes, the freeze cycle ends and water is stopped from flowing over the freeze portion. The solenoid 550 is then opened to allow high-pressure, substantially hot gaseous refrigerant discharged from the compressor 510 to enter the refrigerant circuit 540. The high-pressure, substantially hot gaseous refrigerant in the refrigerant circuit 540 defrosts the freeze portion to facilitate the release of ice from the freeze portion. The individual ice cubes eventually fall off of the freeze portion into an ice bin (not shown). At this time, the harvest cycle ends, and the freeze cycle is restarted to create more ice cubes.

Known evaporator assembly designs require a large amount of copper and individual parts to create the assembly. A typical evaporator assembly will have 48 to 75 parts.

Also adding to the cost of the assembly is the need for all copper surfaces to be plated with nickel to meet food equipment sanitation requirements. The plating process is complex and it is difficult to maintain manufacturing control, thus increasing the likelihood of premature failure and increased warranty expense.

Also, known evaporator assemblies need to be cleaned periodically to remove the buildup of minerals from hard water and disinfected for bacterial growth. Evaporator assemblies have dividers on the freeze surface used to separate ice growth and define pockets for ice cubes. The dividers make it difficult to clean the freeze surfaces completely because of the small size and depth of the cube cell pockets. Some evaporator assemblies may have as many as 400 cube cell pockets. Another difficult to clean area of known evaporator assemblies is where the refrigerant circuit 540 connects to the freeze surface. This area is not accessible for manual cleaning because of the evaporator assembly construction or its positioning in the ice-making apparatus cabinet.

Ice-making apparatus performance is evaluated by two different measures: (1) ice-making capacity in a 24-hour period; and (2) kilowatt hours per 100 pounds of ice produced. Ice harvest times have a direct effect on machine performance. Ice-making apparatuses with longer harvest times time spend less time making ice and are more susceptible to liquid refrigerant slugging the compressor and reducing its functional life. One challenge to releasing the ice more quickly is the use of dividers on the freeze surface for ice cube separation. Ice clings to the dividers, the ice pieces do not release consistently, thereby extending the amount of time required to release the ice. Because of these challenges, manufactures assist the release of ice using mechanical push rods, pressurized air, or potable water supplied to the inside of the evaporator assembly. It is also desirable to harvest all ice at the same time so the machine mode can immediately switch back to ice making. To harvest all of the ice at one time evaporator assemblies bridge all of the cubes together into a slab. However, the ice bridge makes it difficult to break the slab into individual cubes.

Further, prior evaporator assemblies attach the refrigerant circuit 540 directly to the ice freeze surface material on which the ice is formed. This design requires the evaporator assembly to have freeze surface divider geometry or additional parts to manage ice growth and define cube shape.

DETAILED DESCRIPTION

The present disclosure is directed to an evaporator assembly for an ice-making apparatus that improves performance by reducing the amount of time to release ice during the harvest cycle. A substantially flat freeze surface has no raised geometrical features for shaping or dividing ice pieces. Also, a freeze template defines ice formation zones with the ice pieces interconnected by strips rather than formed in a solid slab, and thus all of the ice pieces on the freeze surface are released at the same time by force of gravity and break apart easily.

Figure 1A:
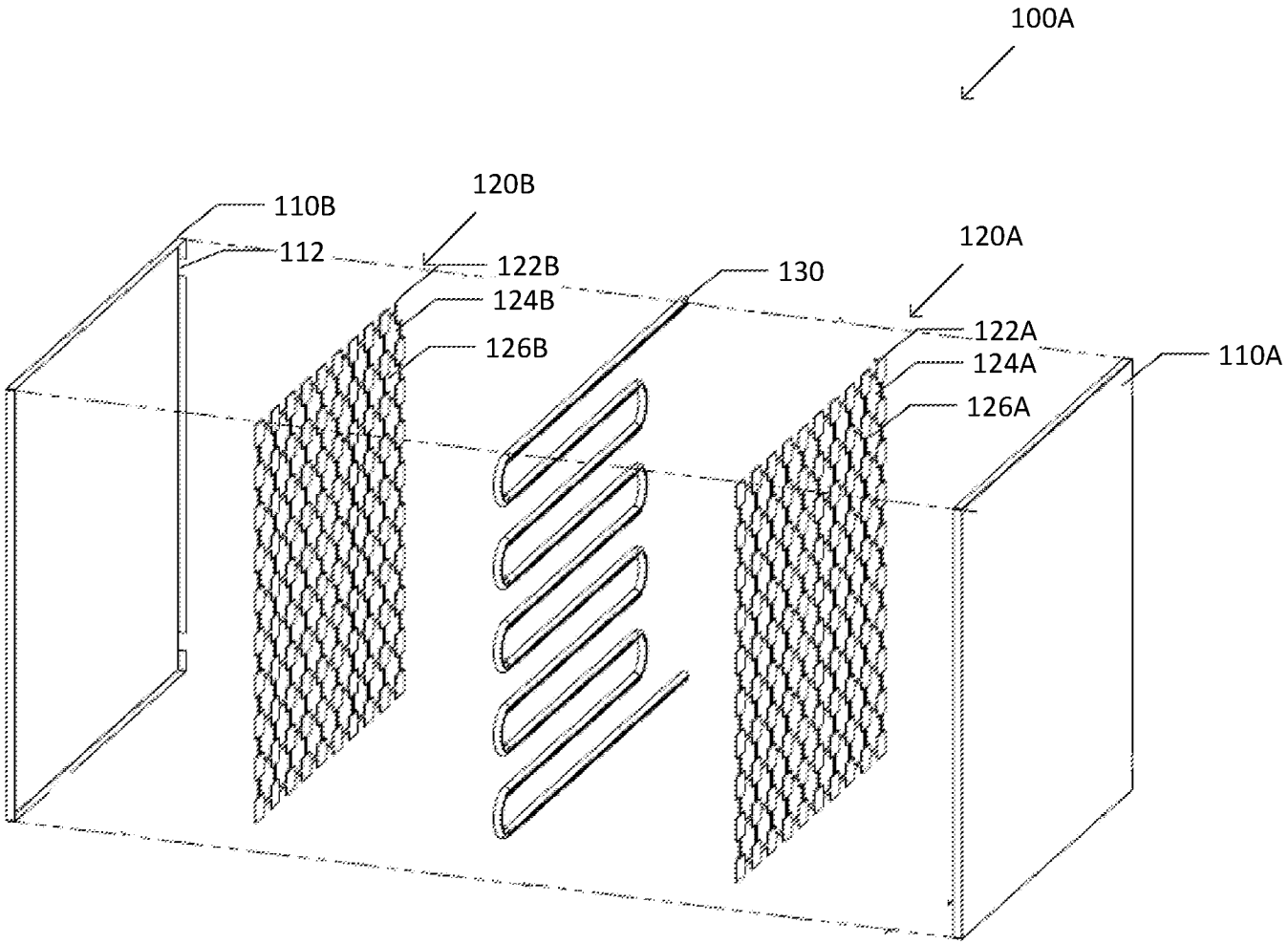
FIG. 1A illustrates an exploded view of an evaporator assembly for an ice-making apparatus in accordance with an exemplary embodiment.
Figure 1B:
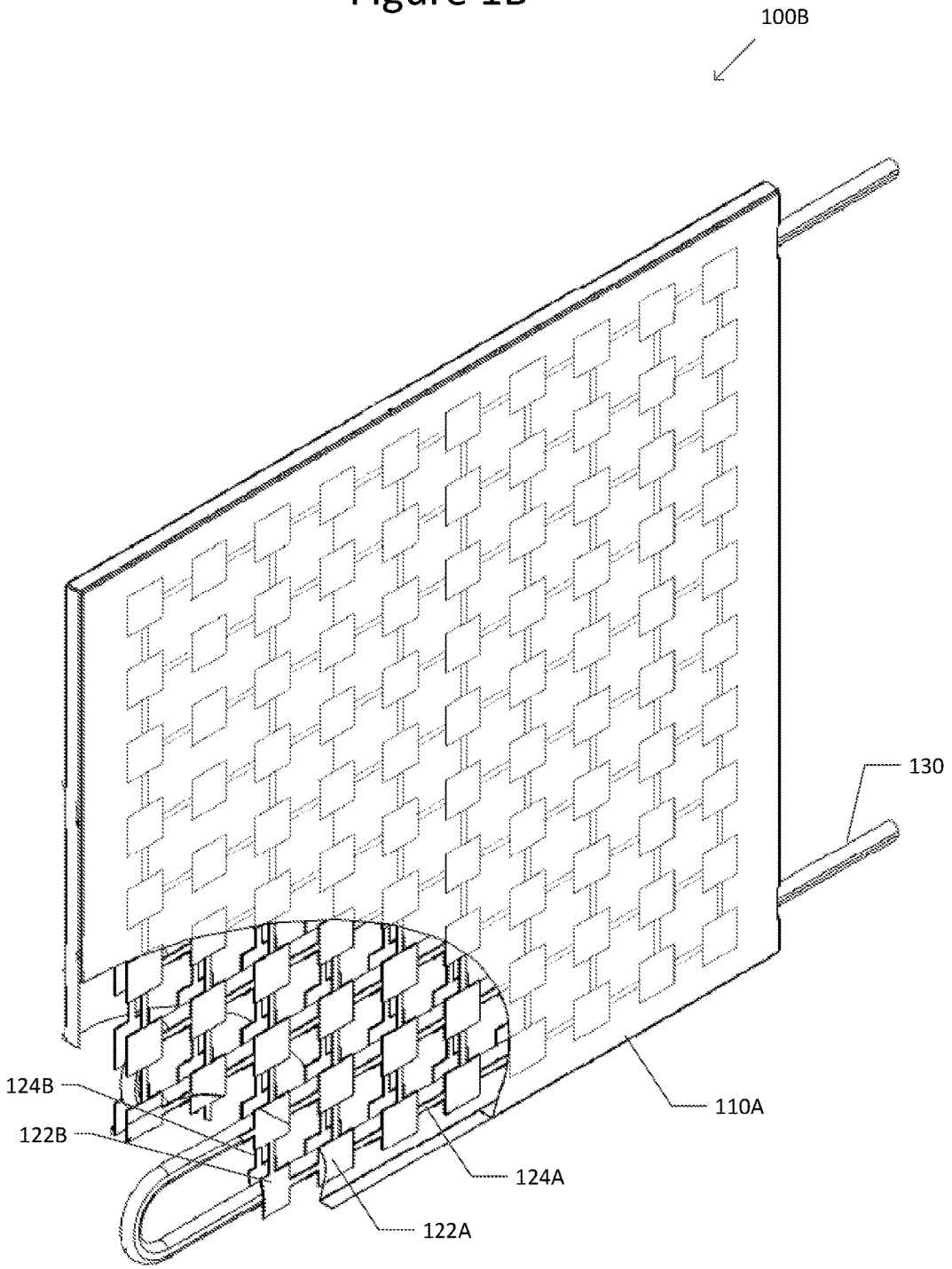
FIG. 1B illustrates a perspective view the evaporator assembly of FIG. 1A.

FIG. 1A illustrates an exploded view of an evaporator assembly 100 for an ice-making apparatus in accordance with an exemplary embodiment. FIG. 1B illustrates a perspective view the evaporator assembly 100 of FIG. 1A.

The evaporator assembly 100 (100A in FIG. 1A and 100B in FIG. 1B) comprises a freeze surface 110A, a freeze template 120A, and a refrigerant circuit 130, in this particular case being a serpentine.

The freeze surface 110A is the component on which ice is formed. The freeze surface 110A is rigid and may be comprised of stainless steel or any thermally conductive material suitable for the intended purpose. The freeze surface is vertical and substantially flat with no raised geometrical features for shaping or dividing ice pieces. Ice clings to raised, geometrical features of prior evaporator assembly designs, thereby extending the amount of time to release the ice. By eliminating these geometrical features, ice harvests faster. Also, eliminating raised freeze surface features for shaping or dividing ice pieces also improves cleaning. Wiping clean a flat surface is much easier than trying to mechanically clean cube formation pockets that can be ⅞" deep with minimal or no radii.

The material of the freeze surface 110A must have a lower thermal conductivity than the material of the freeze template 120A so that ice growth is limited and the ice pieces are clearly defined. The freeze template 120A may be made of copper or any other suitable material.

The freeze template 120A is thermally coupled between the freeze surface 110A and the refrigerant circuit 130. The refrigerant circuit 130 may be made from a metal having a high thermal conductivity, such as aluminum, or alternatively, from another metal having a relatively high thermal conductivity, such as copper.

The freeze template 120 is formed of a plurality of regions 122A arranged in a plane and interconnected by strips 124A having a smaller dimension in the plane than the regions. Alternatively, freeze template 120 may be formed of a plurality of regions 122A arranged in a plane, but without the interconnecting strips.

The regions 122A may be substantially square-shaped as shown. Alternatively, the regions 122A may be round, oval, trapezoidal, irregular, or any other shape suitable for the intended purpose. The regions 122 may each have the same shape, or alternatively may have any combination of shapes.

The freeze template 120A may further comprise insulating regions 126 located between adjacent regions 122A. The insulating regions 126A may be air gaps or any other suitable insulating material. These insulating regions 126A inhibit the freezing of water on corresponding portions of the freeze surface 110A such that distinct ice pieces form.

Interface locations between the freeze template 120A and the freeze surface 110A define on the freeze surface 110A ice formation zones for ice pieces and the webbing with ice strips between ice pieces. When the ice is harvested and falls by force of gravity into an ice bin (not shown), the webbing allows the ice pieces to fall together but break apart easily when they reach the ice bin.

The plurality of regions 122A may be arranged in an array of rows and columns, and each of the plurality of regions 122A is interconnected to an adjacent region 122A in at least two directions. Additionally, horizontal windings of the refrigerant circuit 130 may be arranged to be aligned with the respective rows of the plurality of regions 122A so as to improve thermal coupling.

The freeze template 120A may be bonded to each of the freeze surface 110A and the refrigerant circuit 130 to facilitate heat transfer between the refrigerant ciruit 130, the template 120A and the freeze surface 110A. The bonding may be accomplished using an oven-solder or brazing process, a mechanical joining method such as cladding, adhesive, epoxy, thermally-conductive double-sided tape, or any other suitable material.

The evaporator assembly 100 may include a single freeze surface 110A and a single freeze template 120A. Alternatively, the evaporator assembly 100 may additionally include a second freeze surface 110B and a second freeze template 120B. Like the freeze surface 110A, the second freeze surface 110B is vertical. The second freeze surface 110B may be also be substantially flat and structured similarly to freeze surface 110A, though the disclosure is not limited in this respect.

The second freeze template 120B, like the freeze template 120A, is thermally coupled between the second freeze surface 110B and the refrigerant circuit 130 for thermal conductance therewith. The second freeze template 120B, the refrigerant circuit 130 and the second freeze surface 110B may be bonded together as described above with respect to the freeze template 120A and the freeze surface 110A. Also, the freeze template 120B may be structured as described above with respect to the freeze template 120A. The freeze template 120A and the second freeze template 120B may have matching structures or, alternatively, may have different structures.

The freeze surface 110A and the second freeze surface 110B may be sealed together around their perimeters so as to isolate the evaporator assembly from any food zones. Such a design eliminates the need for plating copper surfaces, such as of the refrigerant circuit 130 and of the freeze templates 120A, 120B. Prior evaporator assembly designs have these components exposed to the food zone and are extremely difficult to clean. The inability to thoroughly clean an evaporator assembly can lead to excessive bacterial growth.

The sealing of the freeze surfaces 110A, 1108 may be accomplished with a material such as caulk, solder, braze alloy, gasketing, fasteners, roll form, adhesive, or any other suitable material. As can be seen in FIG. 1A, notches 112 are formed in the freeze surfaces 110A, 1108 to allow for placement of the respective ends of the refrigerant circuit 130.

Figure 2A:
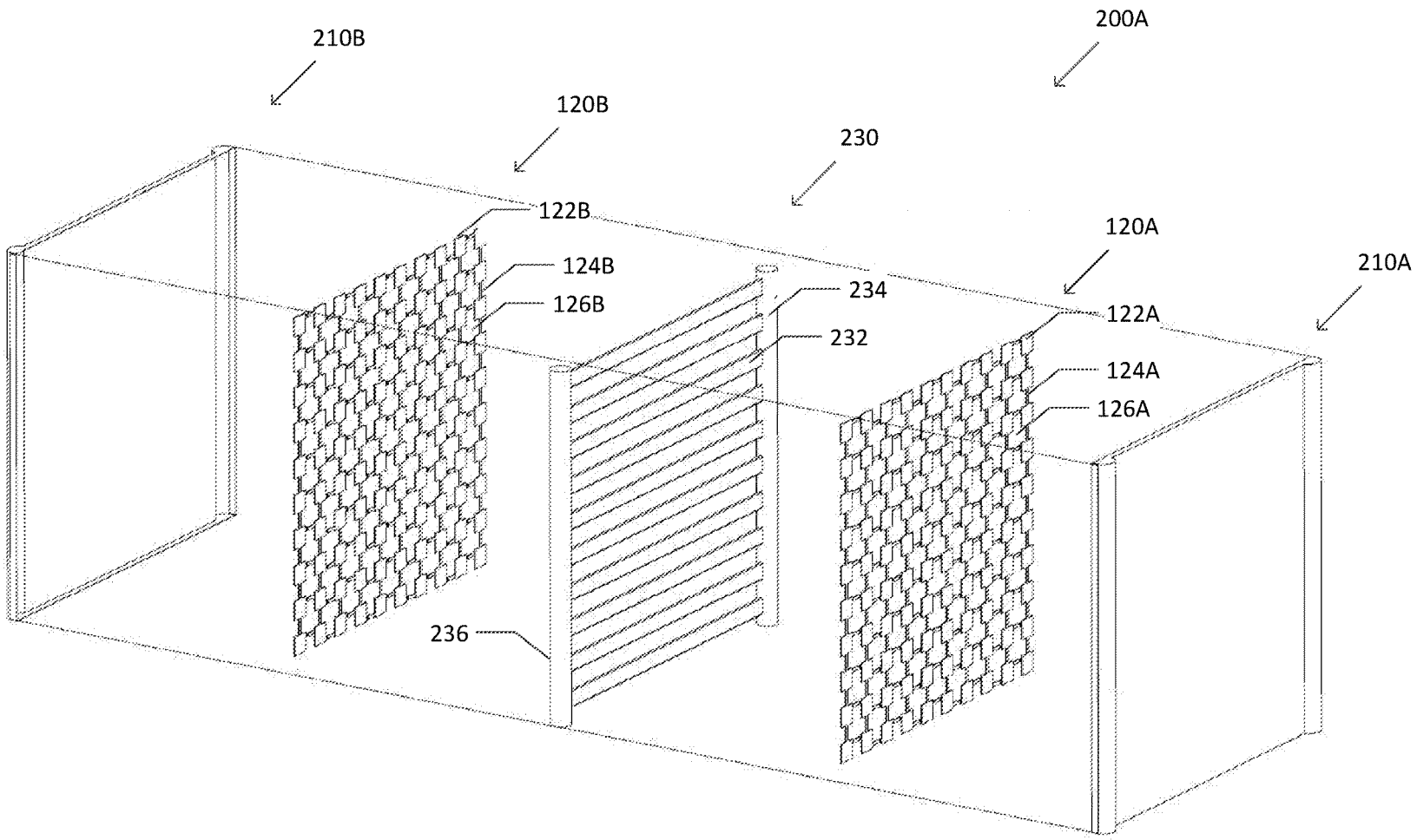
FIG. 2A illustrates an exploded view of an evaporator assembly for an ice-making apparatus in accordance with another exemplary embodiment.
Figure 2B:
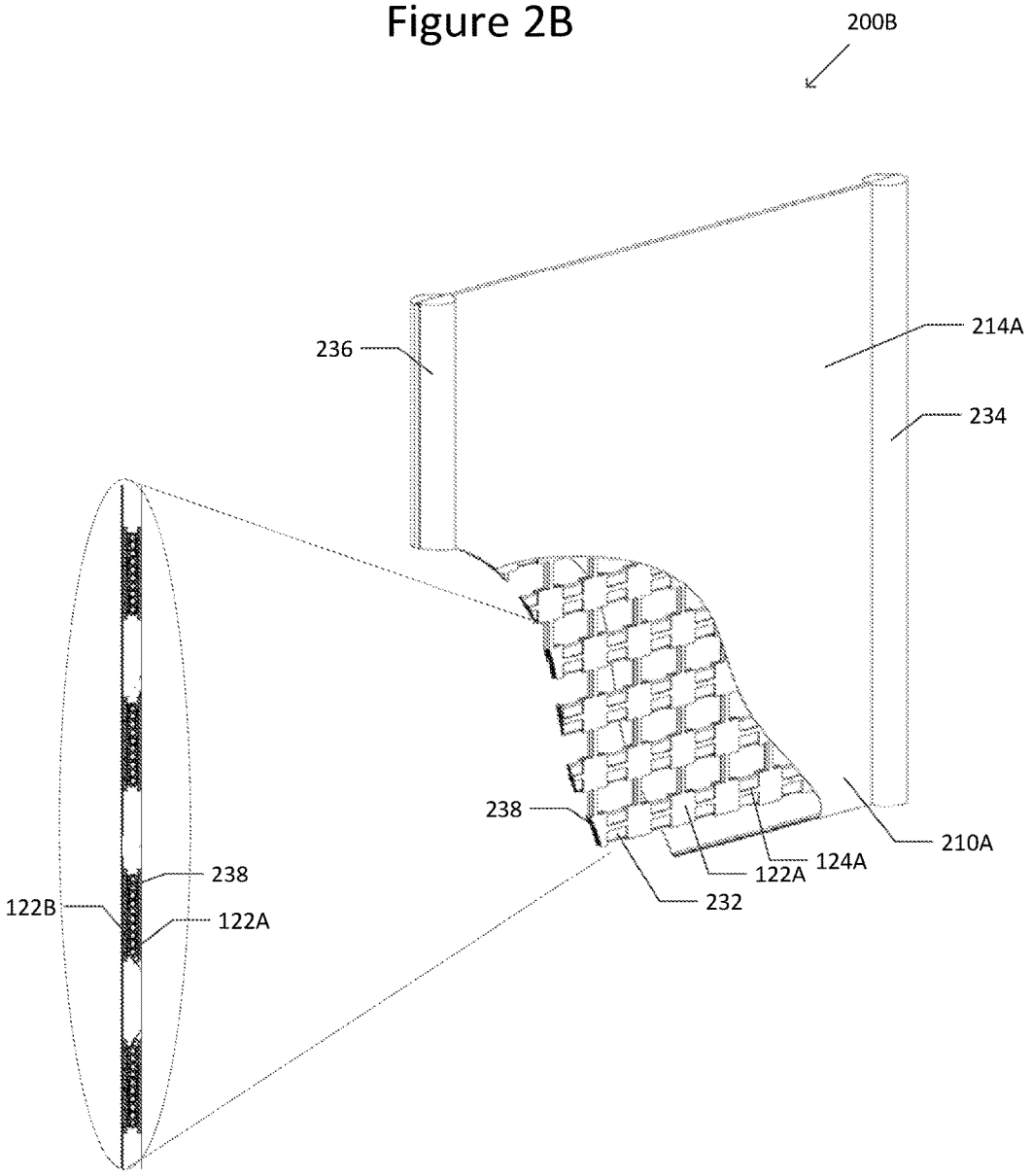
FIG. 2B illustrates a perspective view the evaporator assembly of FIG. 2A.

FIG. 2A illustrates an exploded view of an evaporator assembly 200 for an ice-making apparatus in accordance with another exemplary embodiment. FIG. 2B illustrates a perspective view the evaporator assembly 200 of FIG. 2A.

The evaporator assembly 200 (200A in FIG. 2A, and 200B in FIG. 2B) is similar to the evaporator assembly 100 of FIGS. 1A and 1B, except that the refrigerant circuit 130 of FIGS. 1A and 1B is a microchannel evaporator 230. Also, the freeze surface 110 is replaced with freeze surface 210 (comprises of 210A and 210B) so as to have a shape to accommodate the shape of the microchannel evaporator 230.

Figure 3:
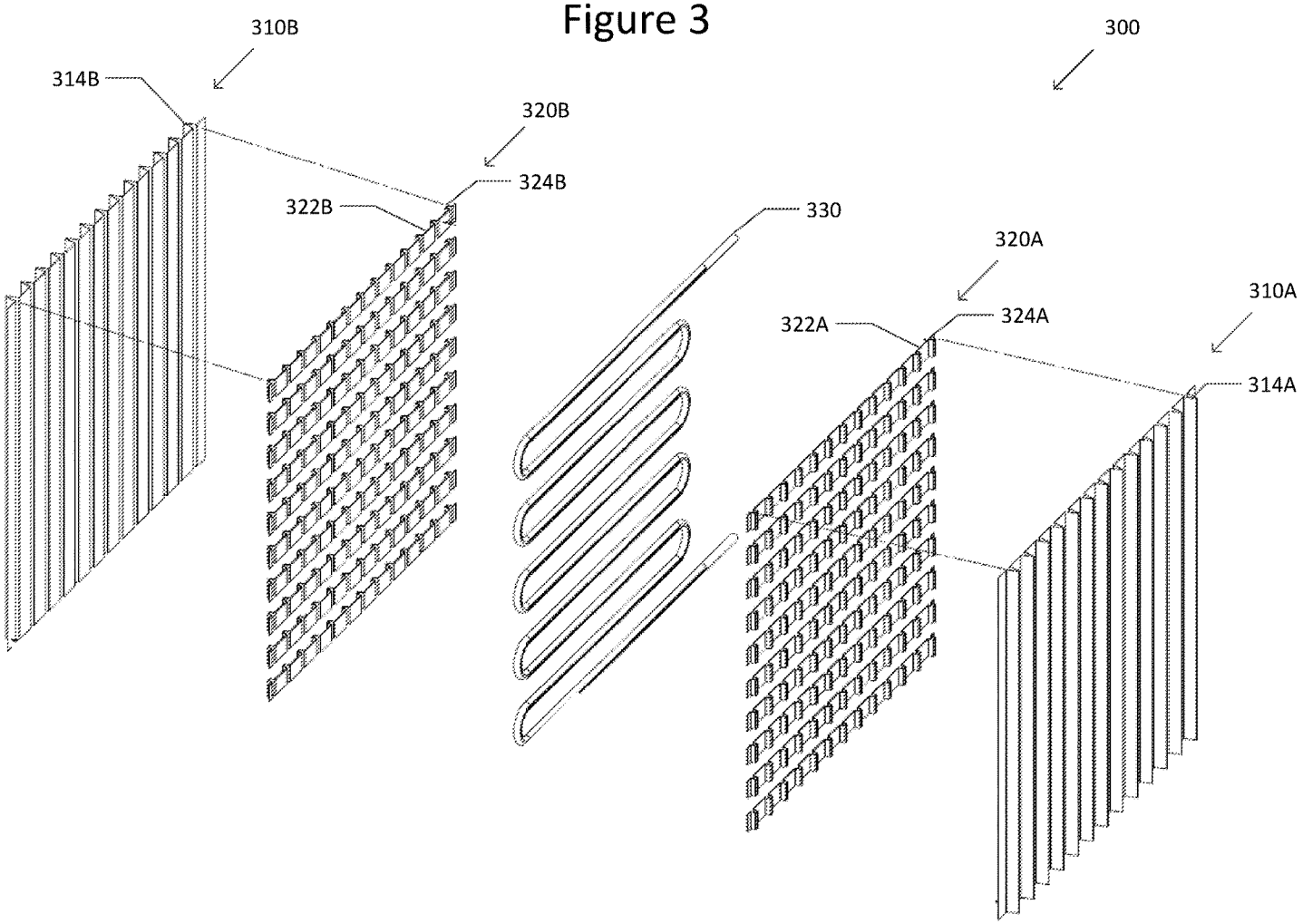
FIG. 3 illustrates an exploded view of an evaporator assembly for an ice-making apparatus in accordance with another exemplary embodiment.

Microchannel evaporator 230 is formed of an inlet header 234, an outlet header 236, and a plurality of tubes 232 fluidly communicating the inlet header 234 and the outlet header 236. The tubes 232 are substantially flat and have a plurality of microchannels 238 formed therein. The tubes 232 may be configured to be horizontal and/or vertical, and may be aligned with the respective rows and/or columns of the plurality of regions 122A for improved thermal coupling. The microchannels 238 have a cross-sectional shape that is any one or more of substantially rectangular, circular, triangular, ovular, trapezoidal, and any other suitable shape. The sizes of each of the tubes 232 and the microchannels 238 may be any sizes suitable for the intended purposes. Further, the tubes 232 may be made from a metal having a high thermal conductivity, such as aluminum, or alternatively, from another metal having a relatively high thermal conductivity, such as copper or steel. FIG. 3 illustrates an exploded view of an evaporator assembly 300 for an ice-making apparatus in accordance with another exemplary embodiment.

The evaporator assembly 300 includes a freeze surface 310A, a freeze template 320A, and a refrigerant circuit 330. Alternatively, the refrigerant circuit 330 may be the microchannel evaporator 230 of FIGS. 2A and 2B.

The freeze surface 310A is vertical and has vertical dividers 314A forming fluid flow channels. The freeze surface 310A is rigid and may be comprised of stainless steel or any thermally conductive material suitable for the intended purpose. The material of the freeze surface 310A must have a lower thermal conductivity than the material of the freeze template 320A so that ice growth is limited and the ice pieces are clearly defined. The freeze template 320A may be made of copper or any other suitable material.

The freeze template 320A is thermally coupled between the freeze surface 310A and the refrigerant circuit 330, and is formed of horizontal strips 322A arranged in a plane. Each of the horizontal strips 322A has a plurality of vertical ribs 324A that when assembled into the evaporator assembly 300 are respectively aligned with the vertical dividers 314A. Interface locations between the freeze template 320A and the freeze surface 310A define on the freeze surface 310A zones where ice is to be formed. Since the vertical ribs 324A align and fit within respective vertical dividers 314A of the freeze plate 310A, ice forms not only on the planar portion of the freeze surface 310A, but also along the sides of the vertical dividers 314A, thereby reducing the time required for the freeze and harvest cycles.

As with the evaporator assembly 100 described above with respect to FIGS. 1A and 1B, evaporator assembly 300 may additionally include a second vertical freeze surface 310B and a second freeze template 320B. The second freeze surface 310B may also have vertical dividers 314B forming fluid flow channels, though the disclosure is not limited in this respect. The second freeze template 320B is thermally coupled, and optionally bonded, between the second freeze surface 310B and the refrigerant circuit 330 for thermal conductance therewith. The freeze surfaces 310A, 310B may be sealed together around their perimeters as described above with respect to freeze surfaces 110A, 100B of FIGS. 1A and 1B to separate the evaporator assembly 100 from any food zones.

Figure 4:
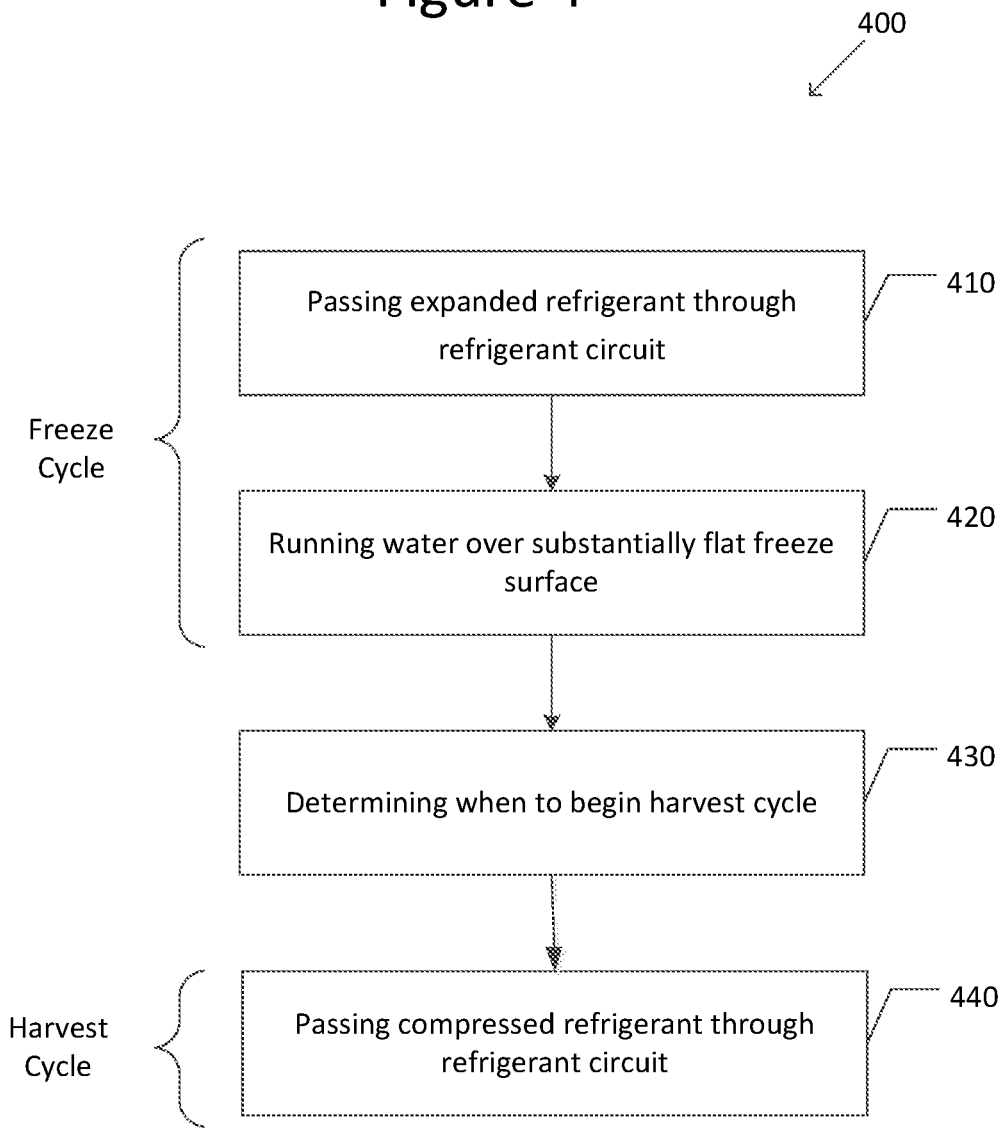
FIG. 4 illustrates a flowchart of a method for forming ice.
Figure 5:
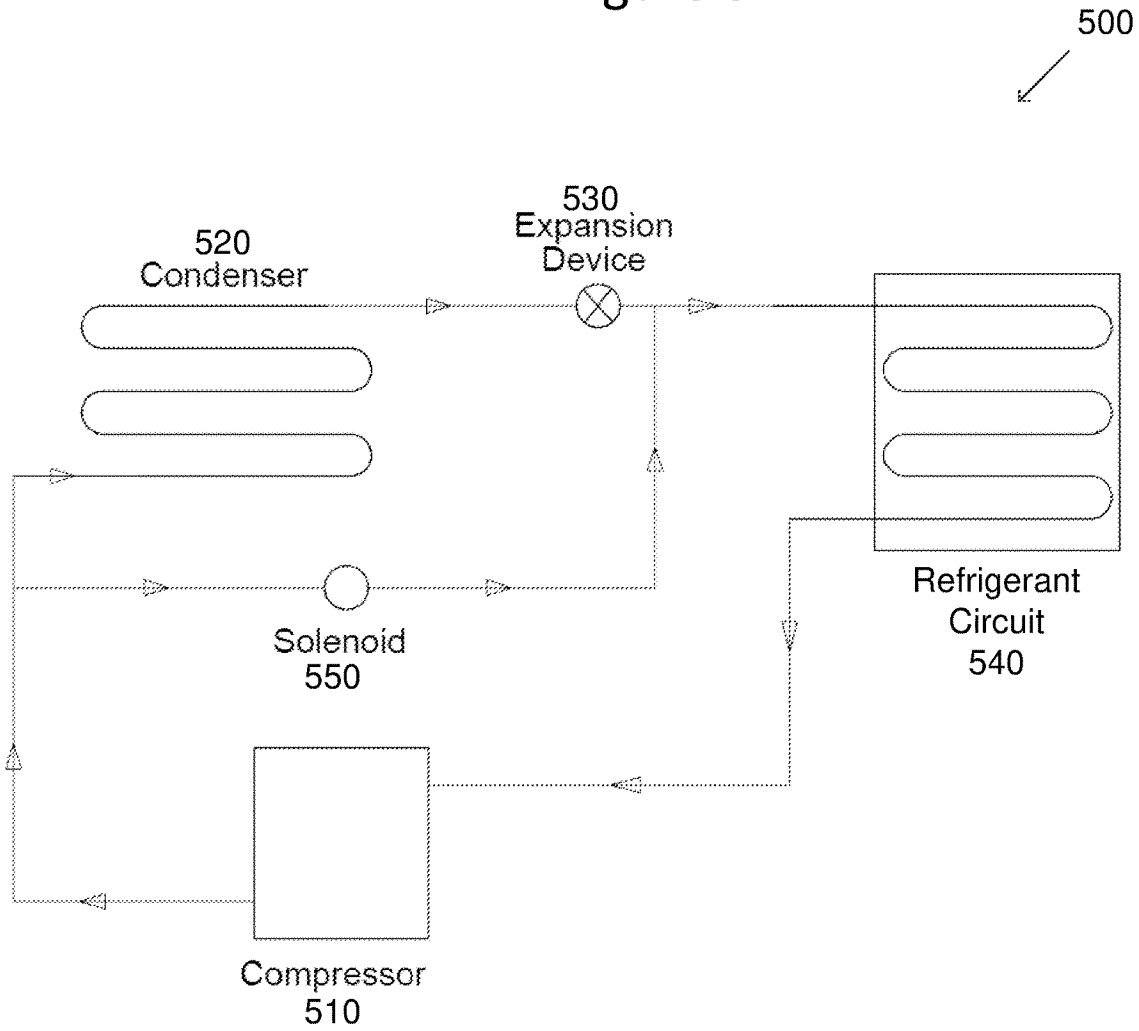
FIG. 5 illustrates a circuit diagram of a refrigeration system that can be used with an evaporator assembly of an ice-making apparatus.

FIG. 4 illustrates a flow chart of a method for forming ice.

A freeze cycle begins at Step 410 when expanded refrigerant is passed through refrigerant circuit 130, 230, 330. At Step 420, water is run over a substantially flat freeze surface 110, 210. The expanded refrigerant in the refrigerant circuit 130, 230, 330 cools the freeze surface 110, 210 for ice formation thereon. A freeze template is thermally coupled between the freeze surface 110, 210 and the refrigerant circuit 130, 230, 330 and is formed of a plurality of regions arranged in a plane. Interface locations between the freeze template and the freeze surface 110, 210 define where on the freeze surface 110, 210 ice is to be formed. The freeze template may be any of freeze templates 120, 320 described with respect to FIGS. 1A, 1B, 2A, 2B, and 3. Alternatively, the freeze template may be configured such that it does not include interconnecting strips connecting the regions.

At Step 430 it is determined when to begin a harvest cycle. This determination may be made by measuring a water level in a sump (not shown) where the flowing water collects at the bottom of the ice-making apparatus, an amount of ice formed on the freeze surface, and/or a temperature, such as of the refrigerant circuit 130, 230, 330.

The harvest cycle is performed at Step 440 by passing compressed refrigerant through the refrigerant circuit 130, 230, 300, wherein heat transfers from the refrigerant circuit 130, 230, 330 to the freeze surface 110, 210 until the freeze surface 110, 210 is warmed to a temperature sufficient to allow ice formed on the freeze surface 110, 210 to fall from the freeze surface 110, 210 by a force of gravity.

The evaporator assembly as disclosed herein results in improved performance, improved cleaning, and reduced assembly cost. The reduced assembly cost is achieved by using less materials and eliminating the need of an expensive plating process required to meet food zone sanitation requirements. Also, not having freeze surface features for shaping or dividing cubes reduces manual assembly time or eliminates stamping operations.

While the foregoing has been described in conjunction with exemplary embodiment, it is understood that the term "exemplary" is merely meant as an example, rather than the best or optimal. Accordingly, the disclosure is intended to cover alternatives, modifications and equivalents, which may be included within the scope of the disclosure.

Although specific embodiments have been illustrated and described herein, it will be appreciated by those of ordinary skill in the art that a variety of alternate and/or equivalent implementations may be substituted for the specific embodiments shown and described without departing from the scope of the present application. This application is intended to cover any adaptations or variations of the specific embodiments discussed herein.

The invention claimed is:

1. An evaporator assembly for an ice-making apparatus, comprising:

a vertical, substantially flat freeze surface;

a refrigerant circuit; and a non-insulating freeze template thermally coupled between the freeze surface and the refrigerant circuit, and formed of a plurality of regions arranged in a plane and interconnected by strips having surfaces coplanar with the plurality of regions, and the strips having a smaller dimension in the plane than the regions, wherein interface locations between the regions of the freeze template and the freeze surface, and between the strips of the freeze template and the freeze surface, define where on the freeze surface ice is to be formed, to thereby form ice pieces and a webbing of ice strips between the ice pieces, and wherein the refrigerant circuit comprises tubes, each having a plurality of microchannels formed therein.

2. The evaporator assembly of claim 1, wherein ice forms on the freeze surface at the interface locations between the freeze surface and freeze template.

3. An evaporator assembly for an ice-making apparatus, comprising:

a vertical freeze surface having vertical dividers forming fluid flow channels;

a refrigerant circuit; and a non-insulating freeze template thermally coupled between the freeze surface and the refrigerant circuit, and being formed of horizontal strips arranged in a plane, each of the horizontal strips having a plurality of vertical ribs respectively aligned with the vertical dividers, wherein interface locations between the freeze template and the freeze surface define where on the freeze surface ice is to be formed.

4. The evaporator assembly of claim 3, further comprising:

a second vertical freeze surface having vertical dividers forming fluid flow channels; and a second freeze template thermally coupled between the second freeze surface and the refrigerant circuit for thermal conductance therewith.

5. The evaporator assembly of claim 4, wherein the freeze surfaces are sealed together around their perimeters.

6. The evaporator of claim 3, wherein the refrigerant circuit has a serpentine shape.

7. The evaporator of claim 3, wherein the refrigerant circuit comprises tubes, each having a plurality of microchannels formed therein.

8. The evaporator assembly of claim 3, wherein the plurality of vertical ribs are respectively arranged to be within the vertical dividers.

9. The evaporator assembly of claim 3, wherein ice forms on the freeze surface at the interface locations between the freeze surface and freeze template.

10. The evaporator assembly of claim 3, wherein each of the horizontal strips is formed as an individual horizontal strip separate of the other of the horizontal strips.

11. A method for forming ice, the method comprising:

performing a freeze cycle by:

passing expanded refrigerant through a refrigerant circuit having tubes, each of the tubes having a plurality of microchannels formed therein; and running water over a vertical, substantially flat freeze surface, wherein a non-insulating freeze template is thermally coupled between the freeze surface and the refrigerant circuit, the freeze template is formed of a plurality of regions arranged in a plane and interconnected by strips having surfaces coplanar with the plurality of regions, and the strips having a smaller dimension in the plane than the regions, and wherein interface locations between the regions of the freeze template and the freeze surface, and between the strips of the freeze template and the freeze surface, define where on the freeze surface ice is to be formed, to thereby form ice pieces and a webbing of ice strips between the ice pieces; and performing a harvest cycle by passing compressed refrigerant through the refrigerant circuit, wherein heat transfers from the refrigerant circuit to the freeze surface until the freeze surface is warmed to a temperature sufficient to allow ice formed on the freeze surface to fall from the freeze surface by a force of gravity.

12. The method of claim 11, wherein ice forms on the freeze surface at the interface locations between the freeze surface and freeze template.

* * * * *